US007770356B2

(12) United States Patent
Frazier et al.

(10) Patent No.: US 7,770,356 B2
(45) Date of Patent: Aug. 10, 2010

(54) BAG TYING APPARATUS HAVING OVER-TRAVEL COMPENSATION ASSEMBLY FOR HOLDER-SHEAR DRIVE ASSEMBLY

(75) Inventors: Jimmy R. Frazier, Norman, OK (US); Jerry Dale Pack, Purcell, OK (US); Clay R. Miller, Blanchard, OK (US)

(73) Assignee: Burford Corp., Maysville, OK (US)

( * ) Notice: Subject to any disclaimer, the term of this patent is extended or adjusted under 35 U.S.C. 154(b) by 4 days.

(21) Appl. No.: 12/246,297

(22) Filed: Oct. 6, 2008

(65) Prior Publication Data

US 2010/0083612 A1 Apr. 8, 2010

(51) Int. Cl.
*B65B 51/04* (2006.01)

(52) U.S. Cl. ..... 53/138.8; 53/138.6; 53/64

(58) Field of Classification Search ..... 53/138.6, 53/138.7, 138.8, 419, 64, 128.1, 138.1, 139.4, 53/410

See application file for complete search history.

(56) References Cited

U.S. PATENT DOCUMENTS

| | | | | | |
|---|---|---|---|---|---|
| 3,059,670 | A | | 10/1962 | Burford et al. | |
| 3,138,904 | A | | 6/1964 | Burford | |
| 3,242,633 | A | * | 3/1966 | Platt, Jr. et al. | 53/138.8 |
| 3,648,432 | A | * | 3/1972 | Zellmer et al. | 53/138.8 |
| 3,825,039 | A | * | 7/1974 | Crabb | 140/93 A |
| 3,919,829 | A | * | 11/1975 | Burford et al. | 53/138.8 |
| 4,005,563 | A | * | 2/1977 | Nitsch | 53/138.8 |
| 4,054,160 | A | * | 10/1977 | Knudsen | 140/93 A |
| 4,621,479 | A | * | 11/1986 | Hoyland | 53/133.3 |
| 4,856,258 | A | * | 8/1989 | Burford et al. | 53/138.8 |
| 4,907,392 | A | * | 3/1990 | Knudsen | 53/138.8 |
| 5,465,549 | A | * | 11/1995 | Lummus | 53/138.8 |
| 5,483,134 | A | | 1/1996 | Frazier et al. | |
| 5,600,938 | A | | 2/1997 | Trimble | |
| 5,628,166 | A | | 5/1997 | Hannon | |
| 5,692,358 | A | * | 12/1997 | Frazier et al. | 53/138.8 |
| 5,708,339 | A | * | 1/1998 | Frazier et al. | 318/468 |
| 5,826,629 | A | | 10/1998 | West | |
| 5,966,900 | A | | 10/1999 | Burford et al. | |
| 6,263,645 | B1 | | 7/2001 | Burford et al. | |
| 6,601,366 | B1 | * | 8/2003 | Grutter | 53/133.7 |
| 6,807,795 | B2 | | 10/2004 | Stoddard et al. | |
| 6,824,629 | B2 | | 11/2004 | DiFabio et al. | |
| 6,854,245 | B1 | | 2/2005 | Stoddard et al. | |
| 7,484,342 | B2 | * | 2/2009 | Frazier | 53/138.7 |
| 2007/0107378 | A1 | * | 5/2007 | Frazier | 53/138.8 |

* cited by examiner

*Primary Examiner*—Paul R Durand
(74) *Attorney, Agent, or Firm*—Peter V. Schroeder; Booth Albanesi Schroeder LLC

(57) ABSTRACT

A bag tying apparatus for tying a ribbon about a gathered neck is provided. A holder-shear drive assembly moves a holder-shear assembly from side to side to grip and cut the ribbon. An over-travel compensation assembly compensates for over-travel of the holder-shear drive assembly relative to the travel of the holder-shear assembly.

20 Claims, 10 Drawing Sheets

PRIOR ART

BAG TYING APPARATUS HAVING OVER-TRAVEL COMPENSATION ASSEMBLY FOR HOLDER-SHEAR DRIVE ASSEMBLY

CROSS REFERENCE TO RELATED APPLICATIONS

Not Applicable

STATEMENT REGARDING FEDERALLY SPONSORED RESEARCH OR DEVELOPMENT

Not Applicable

REFERENCE TO MICROFICHE APPENDIX

Not Applicable

Technical Field

This invention relates to a type of apparatus for gathering a neck of a flexible bag, wrapping a ribbon around the gathered neck of the bag, and twisting the ribbon for closing and sealing the neck of the bag.

BACKGROUND OF THE INVENTION

The following patents disclose apparatus used for closing a flexible bag by attaching and twisting a wire-like ribbon about the neck of a flexible bag: U.S. Pat. No. 3,138,904 issued Jun. 30, 1964 to Earl E. Burford entitled "METHOD AND APPARATUS FOR TYING PACKAGES AND WRAPPING MATERIALS; U.S. Pat. No. 3,059,670 issued Oct. 23, 1962 to Charles E. Burford and Leonard W. Burford entitled "WIRE TWISTING TOOL; U.S. Pat. No. 3,919,829 issued Nov. 18, 1975 to Leonard W. Burford and Charles C. Burford entitled "APPARATUS FOR TYING PACKAGES AND WRAPPING MATERIALS;" U.S. Pat. No. 4,856,258 issued Aug. 15, 1989 to Charles E. Burford and Jimmy R. Frazier entitled "WIRE TYING DEVICE;" U.S. Pat. No. 5,483,134 issued Jan. 9, 1996 to Jimmy R. Frazier, John D. Richardson, and Greg P. Coxsey entitled "RIBBON SENSING DEVICE FOR BAG TYER"; U.S. Pat. No. 5,692,358 issued Dec. 2, 1997 to Jimmy R. Frazier, John D. Richardson, and Greg P. Coxsey entitled "BAG NECK TYING DEVICE;" U.S. Pat. No. 5,826,629 issued Oct. 27, 1998 to Joe E. West entitled "WIRE TYING APPARATUS;" and U.S. Pat. No. 5,708,339 issued Jan. 13, 1998 to Jimmy R. Frazier, John D. Richardson, and Greg P. Coxsey entitled "BAG NECK GATHERING STOP." These U.S. patents are incorporated herein by reference in their entirety for all purposes. If there is any conflict between a reference incorporated by reference and the present disclosure, the present disclosure will control.

Bag tying apparatuses of the type disclosed in the aforementioned patents are commercially available from Burford Corporation of Maysville, Okla. They are constructed to receive packages of product, such as loaves of bread, at speeds of, for example, 100 packages per minute. The design of such bag tying apparatus requires careful consideration of the mass, acceleration, deceleration, and momentum of the moving parts. Further, precise synchronization of parts in assemblies of the apparatus must be maintained throughout repeated tying cycles for the apparatus to operate effectively.

The apparatus hereinafter described offers improvements over the apparatuses described in the above-mentioned patents, for example, to increase the tying rate or to provide apparatuses that require less maintenance.

SUMMARY OF THE INVENTION

A new type of bag tying apparatus is provided for gathering the open end of a bag into a neck and tying the bag neck closed using a ribbon. According to the invention, the apparatus includes: a frame; a gathering means for gathering the open end of a bag into a neck; a holder-shear means for holding a free end of the ribbon adjacent to the gathered neck of the bag and, after the neck of the bag is tied, for cutting the ribbon; a needle means adjacent the holder-shear means, the needle means for engaging the ribbon a distance from the free end and operable to loop a strand of the ribbon about the gathered neck of the bag; a twister means having a hook adjacent the holder-shear means, the twister means for twisting the strand of the ribbon around the gathered neck of the bag; a holder-shear drive means for actuating the holder-shear means; and an over-travel compensation means operatively connected between the holder-shear drive means and the holder-shear means, the over-travel compensation means for compensating for over travel of the holder-shear drive means relative to the travel of the holder-shear means.

The gathering means, the holder-shear means, the needle means, the twister means, the holder-shear drive means, and the over-travel compensation means are operatively supported by the frame.

According to the invention, the holder-shear drive means preferably has the structure of a holder-shear drive assembly. More preferably, the holder-shear drive assembly has the structures of: (a) an eccentric element mounted fixedly on a drive shaft, the eccentric element rotated by the drive shaft; (b) a housing slidingly mounted on the eccentric element, the housing reciprocated along a housing path by the rotating eccentric element; (c) a reciprocating member operatively connected to the housing to be reciprocated by the housing, the reciprocating member operatively connected to the holder-shear means to actuate the holder-shear means, the reciprocating member operable to travel along a reciprocating member path, the reciprocating member limited in its travel at both ends of the reciprocating member path by the holder-shear means, wherein the housing path is greater than the reciprocating member path, and wherein the housing over-travels the reciprocating member.

According to the invention, the over-travel compensation means preferably has the structure of an over-travel compensation assembly. More preferably, the over-travel compensation assembly is operatively connected between the housing and the reciprocating member, wherein the over-travel compensation assembly is operable to allow the housing to move in relation to the reciprocating member when the reciprocating member is at either of the ends of the reciprocating member path, whereby the housing is allowed to travel along the housing path that is greater than the reciprocating member path.

These and further aspects and embodiments of the inventions and various advantages of the aspects and embodiments of the inventions are in the detailed description.

BRIEF DESCRIPTION OF THE DRAWING

A more complete understanding of the present inventions and the advantages thereof may be acquired by referring to the following description taken in conjunction with the accompanying drawings in which.

DESCRIPTION OF A PRESENTLY PREFERRED EMBODIMENT

Figure 1:
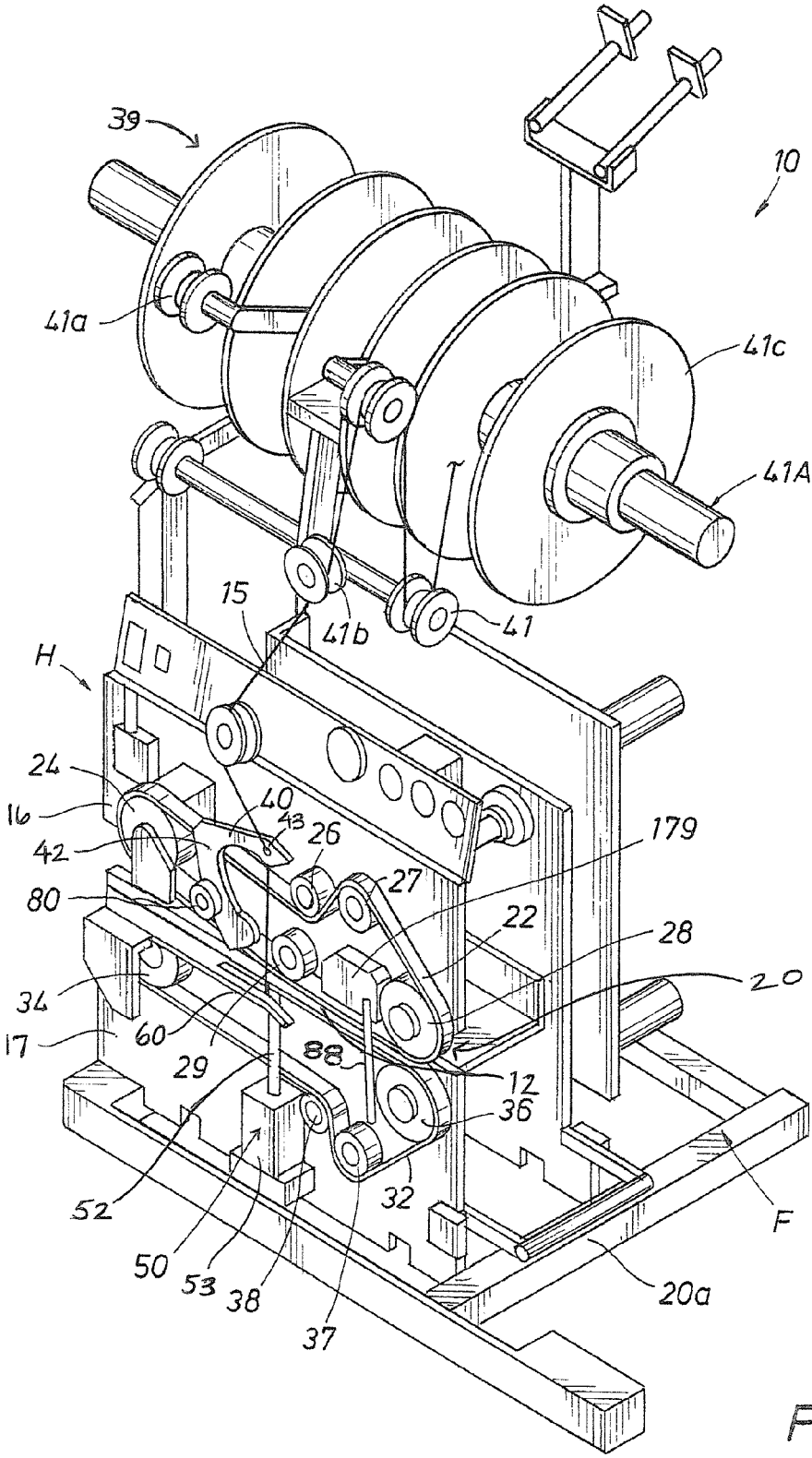
FIG. 1 is a perspective view illustrating the front of a presently preferred embodiment of a bag tying apparatus according to the invention.

As used herein, the words "comprise," "has," and "include" and all grammatical variations thereof are each intended to have an open, non-limiting meaning that does not exclude additional elements or steps.

As used herein, like reference characters will refer to like parts throughout the figures of the drawing.

As used herein, the words such as "needle" in the compound terms such as "needle means" are solely for the purpose of naming and distinguishing the particular means for accomplishing a function from another means for accomplishing a different purpose. For example, the term "needle means" is not to be construed as requiring any structure of a needle, but solely as the "means for engaging the ribbon a distance from the free end and operable to loop the ribbon about the gathered neck of the bag."

As used herein, terms such as "left," "right," "clockwise," "counter-clockwise," "horizontal," "vertical," "up," and "down" when used in reference to the drawings generally refer to orientation of the parts as oriented in the illustration of the embodiment and not necessarily during use of the illustrated apparatus. These terms used herein are meant only to refer to relative positions or orientations, for convenience, and are not to be understood to be in any manner otherwise limiting.

Bag Tying Apparatus 10

Figure 2:
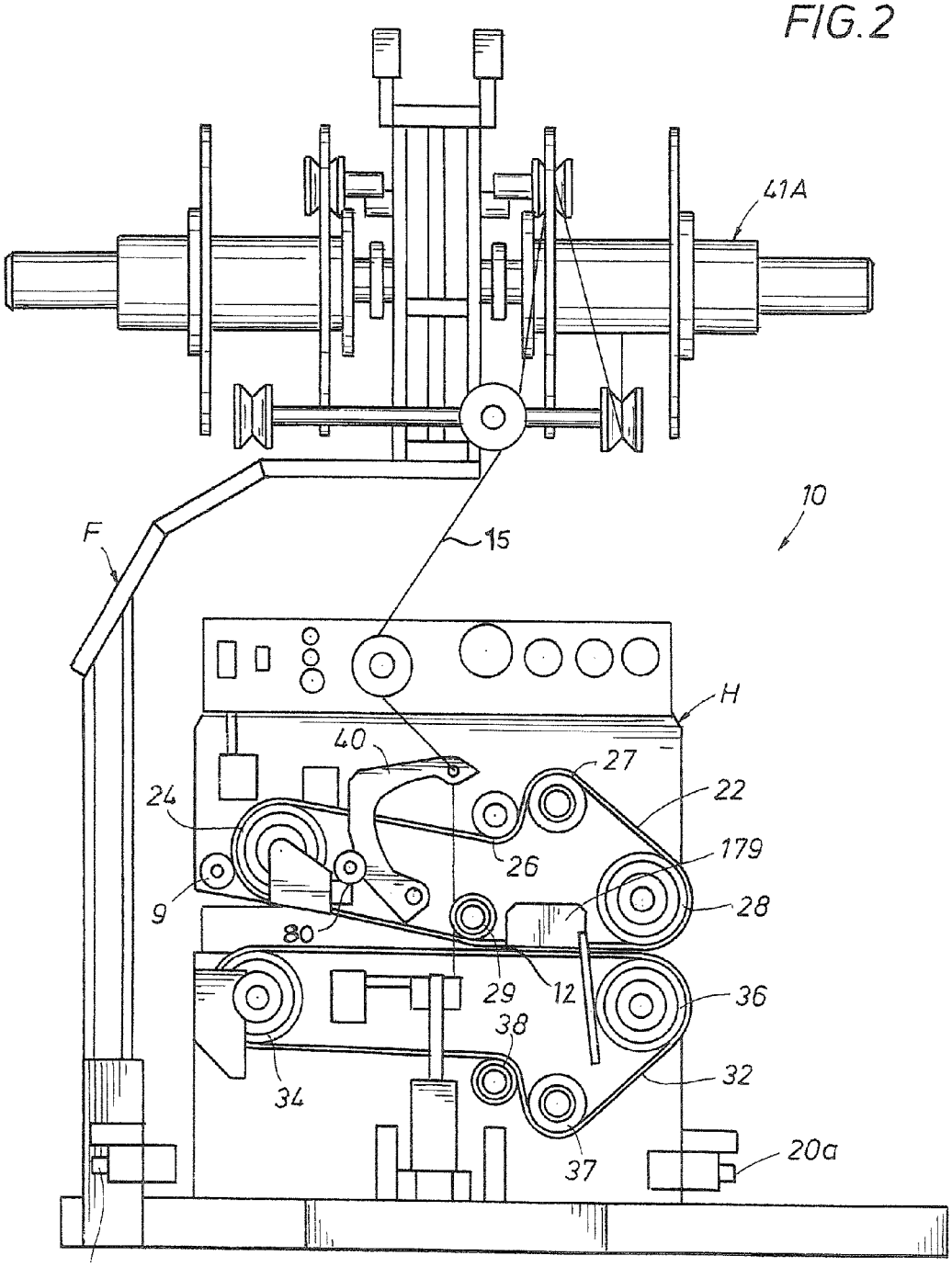
FIG. 2 is a diagrammatic front elevational view of the bag tying apparatus illustrated in FIG. 1.
Figure 3:
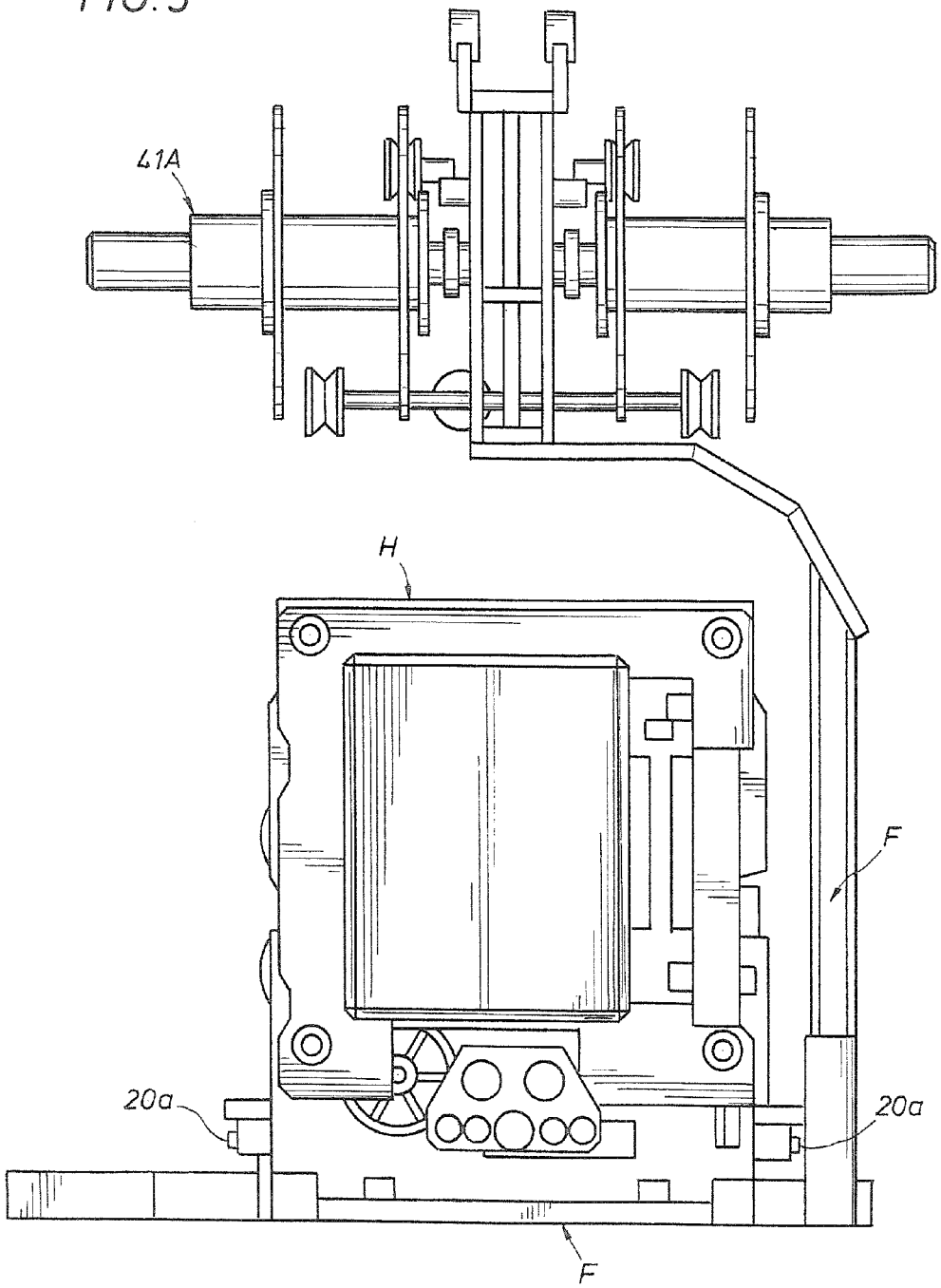
FIG. 3 is a diagrammatic rear elevational view of the bag tying apparatus illustrated in FIG. 1.

Referring first to FIGS. 1, 2, and 3 of the drawing, a bag tying apparatus according to a presently preferred embodiment of the invention is generally designated by the numeral 10. As will hereinafter be described in more detail, the bag tying apparatus 10 includes: a frame; a gathering means for gathering the open end of a bag into a neck; a holder-shear means for holding a free end of the ribbon adjacent to the gathered neck of the bag and, after the neck of the bag is tied, for cutting the ribbon; a needle means adjacent the holder-shear means, the needle means for engaging the ribbon a distance from the free end and operable to loop a strand of the ribbon about the gathered neck of the bag; a twister means having a hook adjacent the holder-shear means, the twister means for twisting the strand of the ribbon around the gathered neck of the bag; a holder-shear drive means for actuating the holder-shear means; and an over-travel compensation means operatively connected between the holder-shear drive means and the holder-shear means, the over-travel compensation means for compensating for over travel of the holder-shear drive means relative to the travel of the holder-shear means. The gathering means, the holder-shear means, the needle means, the twister means, the holder-shear drive means, and the over-travel compensation means are operatively supported by the frame.

A bag tying apparatus according to the invention has a frame for providing a rigid structure onto which the other elements of the bag tying apparatus can be mounted. As illustrated in FIGS. 1, 2, and 3, according to the presently preferred embodiment, for example, the bag tying apparatus 10 has a frame F.

A bag tying apparatus according to the invention has a gathering means for gathering the open end of a bag into a neck. As illustrated in FIGS. 1 and 2, according to the presently preferred embodiment, for example, the bag tying apparatus 10 has a gathering means having the structure of a gathering assembly 20.

A bag tying apparatus according to the invention has a holder-shear means for holding a free end of the ribbon adjacent to the gathered neck of the bag and, after the neck of the bag is tied, for cutting the ribbon. According to the presently preferred embodiment, for example, the bag tying apparatus 10 has a holder-shear means having the structure of holder-shear assembly 60 as illustrated in the prior art bag tying apparatus 10A of FIG. 1A. A person of skill in the art will appreciate that the holder-shear assembly 60 illustrated in FIG. 1A can be incorporated into the bag tying apparatus 10 illustrated in FIG. 1. In addition, the holder-shear assembly 60 will be hereinafter described in detail with reference to FIG. 4.

A bag tying apparatus according to the invention has a needle means adjacent the holder-shear means, the needle means for engaging the ribbon a distance from the free end and operable to loop a strand of the ribbon about the gathered neck of the bag. As illustrated in FIGS. 1 and 2, according to the presently preferred embodiment, for example, the bag tying apparatus 10 has a needle means having the structure of needle assembly 40.

A bag tying apparatus according to the invention has a twister means adjacent the holder-shear means, the twister means for twisting the strand of the ribbon around the gathered neck of the bag. According to the presently preferred embodiment, for example, the bag tying apparatus 10 has a twister means having the structure of a twister assembly 50 as illustrated in the prior art bag tying apparatus 10A of FIG. 1A. A person of skill in the art will appreciate that the twister assembly 50 illustrated in FIG. 1A can be incorporated into the bag tying apparatus 10 illustrated in FIG. 1.

A bag tying apparatus according to the invention has a holder-shear drive means for actuating the holder-shear means. According to the presently preferred embodiment, for example, the bag tying apparatus 10 has a holder-shear drive means having the structure of holder-shear drive assembly 100. The holder-shear drive assembly 100 is operatively connected to the holder-shear assembly 60. The holder-shear drive assembly 100 will be hereinafter described in detail with reference to FIGS. 5, 6, and 8-11.

A bag tying apparatus according to the invention has an over-travel compensation means operatively connected between the holder-shear drive means and the holder shear, the over-travel compensation means for compensating for over travel of the holder-shear drive means relative to the travel of the holder-shear means. According to the presently most preferred embodiment of the invention, the over-travel compensation means is operatively positioned within the holder-shear drive means. According to the presently preferred embodiment for example, the bag tying apparatus 10 has an over-travel compensation means having the structure of over-travel compensation assembly 134. The over-travel compensation assembly 134 will be hereinafter described in detail with reference to FIGS. 5, 6, and 8-11.

In the bag tying apparatus 10, the gathering assembly 20, the holder-shear assembly 60, the needle assembly 40, the twister assembly 50, the holder-shear drive assembly 100, and the over-travel compensation assembly 134 are operatively supported by the frame F.

The details and cooperation of the gathering assembly 20, the holder-shear assembly 60, the needle assembly 40, the twister assembly 50, the holder-shear drive assembly 100, and the over-travel compensation assembly 134 will be hereinafter described.

Bag Tying Apparatus 10 Connected to or Adjacent a Conveyor

The bag tying apparatus 10 is adapted to be mounted to or otherwise secured adjacent the side of a conveyor (not shown). The conveyor is for conveying a plurality of bags, each bag having a product, such as a loaf of bread, positioned therein. An example of such a relationship between a bag tying apparatus and a conveyor is illustrated in U.S. Pat. No. 5,483,134, FIG. 2, the disclosure of which is incorporated herein by reference in its entirety for all purposes. The conveyor carries a bagged product in rapid succession adjacent to the bag tying apparatus 10 such that the bag tying apparatus can gather and tie the neck of the bags.

In the prior art bag tying apparatus 10A, a front discharge cover was difficult to open if it were blocked by a bag. In the presently most preferred embodiment of the bag tying apparatus 10, a front discharge cover (not shown) opens to the conveyor side of the bag tying apparatus. The new cover swings up and out of the way on an arc, eliminating this problem while providing better access to the internals of the bag tying apparatus.

Bag Tying Apparatus 10 Having or Connected to a Ribbon Dispenser

As shown in FIGS. 1 and 2, the bag tying apparatus 10 uses a ribbon 15 to tie the neck of a bag. The ribbon 15 can be constructed of wire enclosed in paper or plastic or it can comprise a ribbon of plastic or any other suitable material for tying the neck of a bag.

The bag tying apparatus 10 preferably has a ribbon dispenser for dispensing a length of ribbon having a free end, in which case the ribbon dispenser is also attached to the frame F. According to the presently preferred embodiment, for example, the bag tying apparatus 10 has a ribbon dispenser 39. As best illustrated in FIG. 1, the ribbon dispenser 39 includes ribbon pulleys 41, 41*a*, and 41*b* and at a spool 41*c* mounted on spool shaft 41A. The ribbon 15 extends from the spool 41*c* around the pulleys 41, 41*a*, and 41*b*, through the needle assembly 40, and to the holder-shear assembly 60. The ribbon dispenser 39 is operatively connected to the frame F. It is also contemplated that the bag tying apparatus can be selectively and operatively connected to a ribbon dispenser that is independently supported adjacent the conveyor.

Bag Tying Apparatus 10 Having or Connected to a Motor

The bag tying apparatus 10 preferably includes a motor 160 for driving the drive shaft 162 of the holder-shear drive assembly 100, in which case the motor 160 is attached to the frame F. It is also contemplated that a motor for the holder-shear drive assembly 100 of the bag tying apparatus 10 can be selectively and operatively connected to a motor independently supported adjacent the conveyor. The bag tying apparatus 10 also preferably includes a motor, which can be the same or different than motor 160, operatively connected for driving the needle assembly 40 and the twister assembly 50. Most preferably, the motor 160 is a brushless motor.

Head of Bag Tying Apparatus 10 is Preferably Removable from Frame

Referring to FIGS. 1, 2, and 3, the bag tying apparatus 10 preferably has a head H that is removable from the frame F. The head H preferably includes at least the gathering assembly 20, the holder-shear assembly 60, the needle assembly 40, the twister assembly 50, the holder-shear drive assembly 100, and the over-travel compensation assembly 134 mounted on upper and lower face plates 16 and 17. The head H of the bag tying apparatus 10 is adapted to be removably secured in the bag tying apparatus 10. For example, the head H can be removably attached to frame F by suitable quick connect devices, such as clamps (not shown), at 20*a* on the frame F. Thus, the head H of the bag tying apparatus 10 is preferably separable from the rest of the bag tying apparatus 10. With this approach, the "guts" of the bag tying apparatus 10, that is, at least the gathering assembly 20, the holder-shear assembly 60, the needle assembly 40, the twister assembly 50, the holder-shear driver assembly 100, and the over-travel compensation assembly 134 mounted on the upper and lower face plates 16 and 17, can be removed from the frame F, which can remain attached to or adjacent to a conveyor. A replacement head H can be quickly substituted in the bag tying apparatus 10 so that bag tying can continue with minimal interruption.

Preferably, various sensors and controls of the bag tying apparatus 10 are also included on the head H instead of being located remotely. More preferably, the various sensors and controls are located on an exposed surface of the head H for easy access or repair.

Preferably, the ribbon dispenser 39 is not part of the head H, which makes the head lighter and easier to replace.

Operation of Bag Tying Apparatus 10

Referring to FIG. 1 of the bag tying apparatus 10, as will be hereinafter explained in detail, the gathering assembly 20 gathers the neck of a bag along a path 12 to a position adjacent the needle assembly 40, the twister assembly 50, and the holder-shear assembly 60. When the neck of a bag is gathered, the free end of a ribbon 15 of a wire-like material is gripped in holder-shear assembly 60. The neck of the bag moves through a neck path 12 between the upper faceplate 16 and the lower faceplate 17 for drawing the bag to a controlled tension about the contents thereof Needle assembly 40 wraps the ribbon 15 about the gathered neck of the bag and twister assembly 50 twists a portion of the ribbon 15 about the neck of the bag.

Gathering Assembly 20

Referring to FIGS. 1 and 2 of the drawing, gathering assembly 20 comprises, in a preferred embodiment of the invention, an upper gathering belt 22 routed around a driven pulley 24 and idler pulleys 26, 27, 28, and 29. The gathering assembly 20 further comprises a lower gathering belt 32 routed around a driven pulley 34 and idler pulleys 36, 37, and 38. As best illustrated in FIG. 1 of the drawing, the portion of the upper gathering belt 22 that extends between idler pulleys 28 and 29 is parallel and closely spaced relative to the portion of the lower gathering belt 32 that extends between driven pulley 34 and idler pulley 36. In the illustrated embodiment, gathering belts 22 and 32 move a bag neck along the neck path 12 in a plane.

It should be appreciated that the path of the upper gathering belt 22 from roller 26 around roller 27 and roller 28 and the path of the lower gathering belt 32 from roller 38 around roller 37 and roller 36 are symmetrical paths on the in-feed adjacent rollers 28 and 36. This symmetrical arrangement assures that the portion of the upper gathering belt 22 that extends between idler pulleys 28 and 29 moves at an equal speed to the portion of the lower gathering belt 32 that extends between driven pulley 34 and idler pulley 36. Routing the upper and lower gathering belts 22 and 32 along symmetrical paths at the in-feed adjacent rollers 28 and 36 reduces belt wear caused by the belts rubbing against each other at different linear velocities.

The path of the upper gathering belt 22 from roller 26 around roller 27 and roller 28 and the path of the lower gathering belt 32 from roller 38 around roller 37 and roller 36 are substantially mirror images of the other. However, roller 36 is mounted to lower faceplate 17 to permit separation of rollers 28 and 36 if a heel on a loaf of bread in a bag falls down into the nip between rollers 28 and 36. Lower roller 36 is urged by a spring upwardly toward roller 28, but the lower roller 36 can pivot downwardly if necessary to allow a heel or other obstruction to pass through the nip between rollers 28 and 36, which otherwise could cause the heel to jam the rollers or tear the bag.

A continuously supported upper belt guide 179 urges upper gathering belt 22 downwardly to tightly hold the bag between the upper and lower gathering belts 22 and 32 to prevent the bag from being pulled down into a twister hook 54 of the twister assembly 50 during the tie cycle. The upper belt guide 179 also reduces wear on the lower gathering belt 32 by spreading the contact area over a larger area, reducing the pressure. A pressure pad is resiliently urged upwardly by springs acting through bell cranks (not shown), which maintain belts 22 and 32 in frictional engagement with the neck of a bag to be tied.

As the trailing edge of the neck of a bag passes over the end of switch arm 88, switch arm 88 will move back to the position illustrated in FIG. 1 to send a signal to a microcontroller for starting a new tying cycle. Other and further switching devices may be employed to initiate a tying cycle, such as use an ultrasonic sensor to detect the bag rather than the trigger arm/switch combination, which can eliminate mechanical wear and problems of getting the switch to actuate at the proper position.

The upper and lower gathering belts 22 and 32 on the bag tying apparatus 10 are mounted close to the upper and lower faceplates 16 and 17 to provide a straight ribbon path between the needle assembly 40, holder-shear assembly 60, and twister assembly 50. This assures that the twister assembly 50 is not under the belts 22 and 32, which could cause the tie material 15 to be drawn against the side of the lower belt 32 as it is being tied. This also allows the holder-shear assembly 60 to be raised ¼" and the twister assembly 50 to be raised 3/16" relative to the spacing in the prior art bag tying apparatus 10A illustrated in FIG. 1A. This uses approximately ½" less of ribbon and provides a tighter bag neck closure. The use of less ribbon can mean a significant saving in consumables for the end user.

Continuing to refer to FIGS. 1 and 2, the gathering assembly 20 also includes a bag stop lever 80 mounted on a shaft for rotary movement about a horizontal axis, which holds the bag during the tie cycle. The stop is operated by the needle assembly 40, which has a slightly modified motion relative to the prior art bag tying apparatus 10A illustrated in FIG. 1A. In the "home" position, the needle 42 of the needle assembly 40 (as will be hereinafter described in detail) is rotated approximately 20 degrees further toward the downstream side of the bag tying apparatus 10. In this position, the bag stop lever 80 is held out of the bag neck path 12 by a lever contacting the needle 42. Once a bag passes the bag switch 88 the needle 42 is moved forward such that the bag stop lever 80 is no longer in contact with the needle, allowing the bag stop lever to drop and hold the bag neck. Once the tie cycle is complete, the needle 42 rotates back, lifting the bag stop lever 80 out of the way. This design provides more holding force on the neck of the bag.

Needle Assembly 40

Figure 1A:
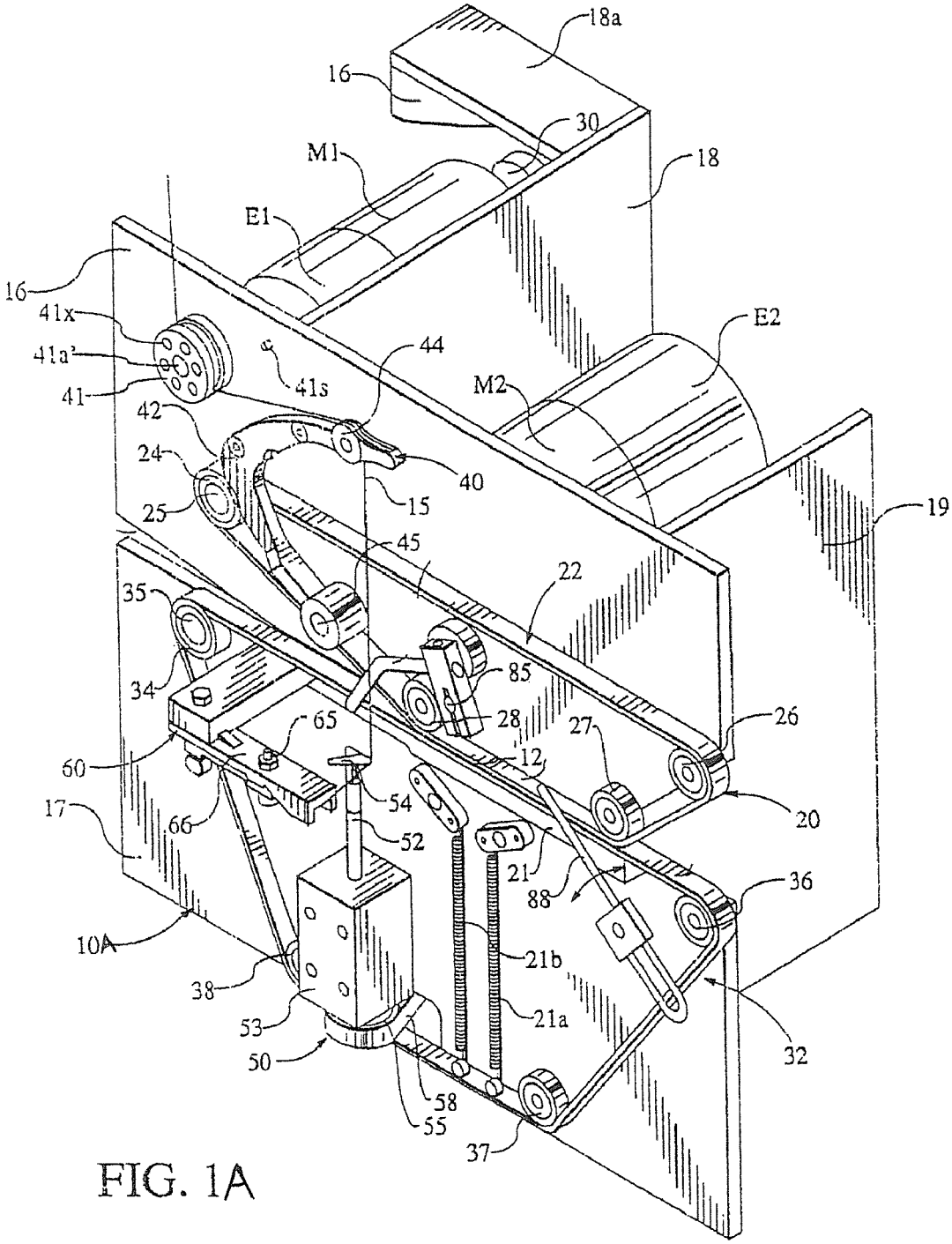
FIG. 1A is a perspective view illustrating the front of a prior art bag tying apparatus for the purpose of illustrating an example of a holder-shear assembly and a twister assembly that can be employed in a bag tying apparatus according to the present invention.

A needle assembly 40, best illustrated in FIGS. 1 and 2, is positioned for wrapping a strand of ribbon material 15 around a gathered neck of a bag. The needle assembly 40 comprises a needle 42 carrying idler rollers 44, 44*a*, and 44*b*. Referring briefly to FIG. 1A, the needle 42 is mounted on the output shaft 45 of a gearbox driven by a motor. Referring back to FIGS. 1 and 2, needle 42 is shown in a home position. The motor moves needle 42 from the home position shown to a lowered position, rotated clockwise from the home position with the eye 43 (or similar) rotated adjacent holder-shear assembly 60. The motor then reverses and moves the needle 42 back to the home position illustrated in FIGS. 1 and 2. For a fuller explanation of the needle assembly, see U.S. Pat. No. 5,483,134 issued Jan. 9, 1996 to Jimmy R. Frazier, John D. Richardson, and Greg P. Coxsey entitled "RIBBON SENSING DEVICE FOR BAG TYER," which is incorporated herein by reference in its entirety.

Twister Assembly 50

Referring to FIGS. 1A of the drawing, a twister assembly 50 comprises a twister shaft 52 rotatably mounted in a bearing 53 having a hook 54 on one end thereof and a pulley 55 on the other end. A drive pulley 56 is mounted on the drive shaft of a motor and drives pulley 55 through a belt 58. For a fuller explanation of the needle assembly, see U.S. Pat. No. 5,483,134 issued Jan. 9, 1996 to Jimmy R. Frazier, John D. Richardson, and Greg P. Coxsey entitled "RIBBON SENSING DEVICE FOR BAG TYER," which is incorporated herein by reference in its entirety. A person of skill in the art will appreciate that the twister assembly 50 illustrated in FIG. 1A can be incorporated into the bag tying apparatus 10 illustrated in FIG. 1.

Holder-Shear Assembly 60

Figure 4:
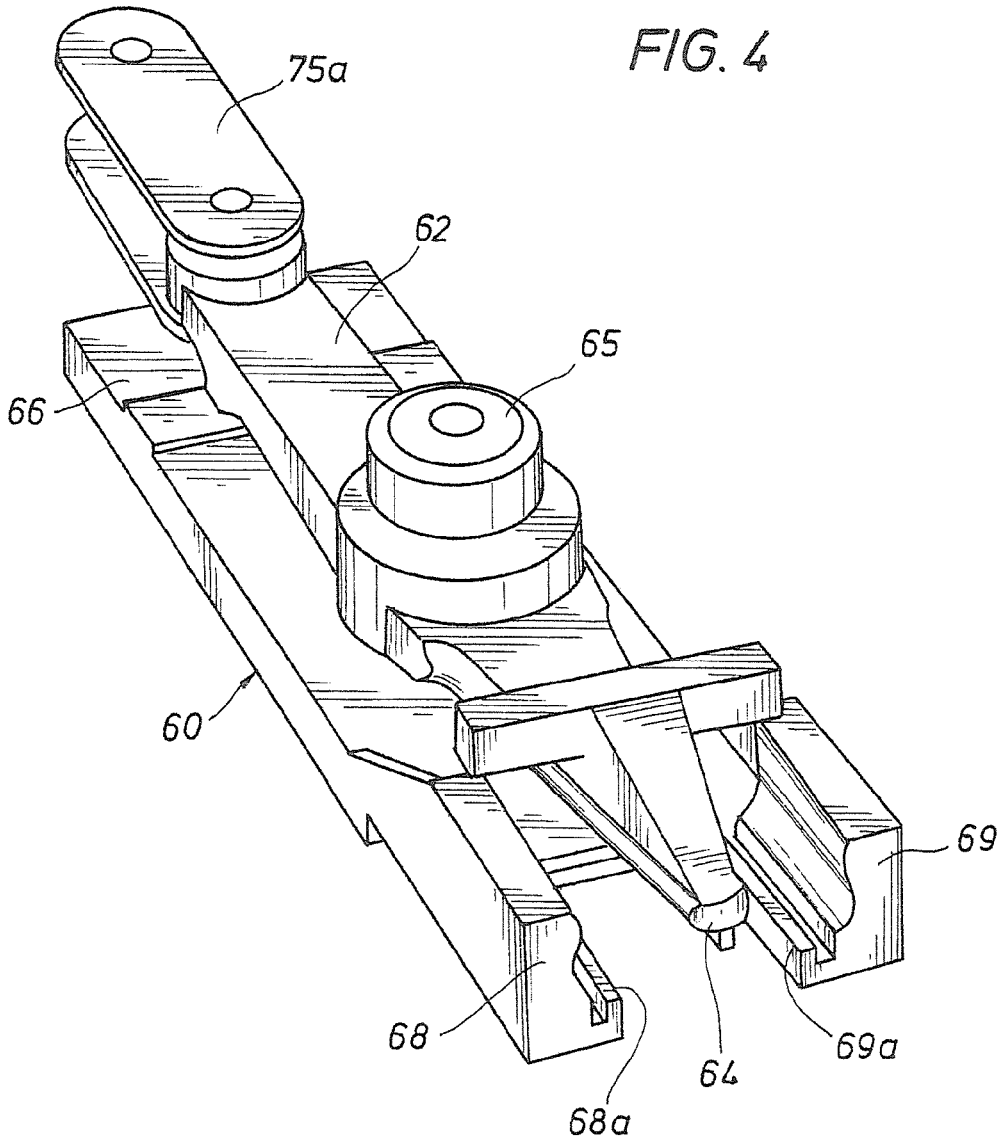
FIG. 4 is a detail perspective view of a holder-shear assembly of the bag tying apparatus illustrated in FIG. 1.

Referring to FIG. 4 of the drawing, a holder-shear assembly, generally designated by the numeral 60, comprises a holder-shear assembly of the type disclosed in U.S. Pat. No. 4,856,258 entitled WIRE TYING DEVICE, which issued Aug. 15, 1989, to Charles E. Burford and Jimmy R. Frazier, which is hereby incorporated by reference in its entirety. The holder-shear assembly 60 comprises a gripper arm 62 having a gripper finger 64 on one end thereof rotatably secured to a mounting plate 66 by bolt 65. A pair of anvils 68 and 69 is formed on the end of mounting plate 66, each being associated with shear surfaces 68*a* and 69*a* to grip and cut a strand of ribbon (not shown in FIG. 4). The free end of a ribbon is gripped between the end of gripper finger 64 and anvil 68 or 69, depending on which direction the gripper finger 64 is shifted. When the needle assembly 40 wraps an intermediate section of the ribbon 15 around the gathered neck of a bag, the ribbon will be positioned between gripper finger 64 and the other anvil 68 or 69. When gripper finger 64 is shifted to its opposite position, the ribbon will be cut and the free end of the strand of ribbon will be gripped between gripper finger 64 and anvil 68 or 69.

Holder-Shear Drive Assembly and Over-Travel Compensation Assembly

According to the invention, a holder-shear drive means is provided for actuating the holder-shear assembly and an over-travel compensation means operatively connected between the holder-shear drive means and the holder-shear means, the over-travel compensation means for compensating for over travel of the holder-shear drive means relative to the travel of the holder-shear means. According to the presently preferred embodiment, for example, the bag tying apparatus 10 has a holder-shear drive means having the structure of holder-shear drive assembly 100 and an over-travel compensation means having the structure of over-travel compensation assembly 134.

Figure 5:
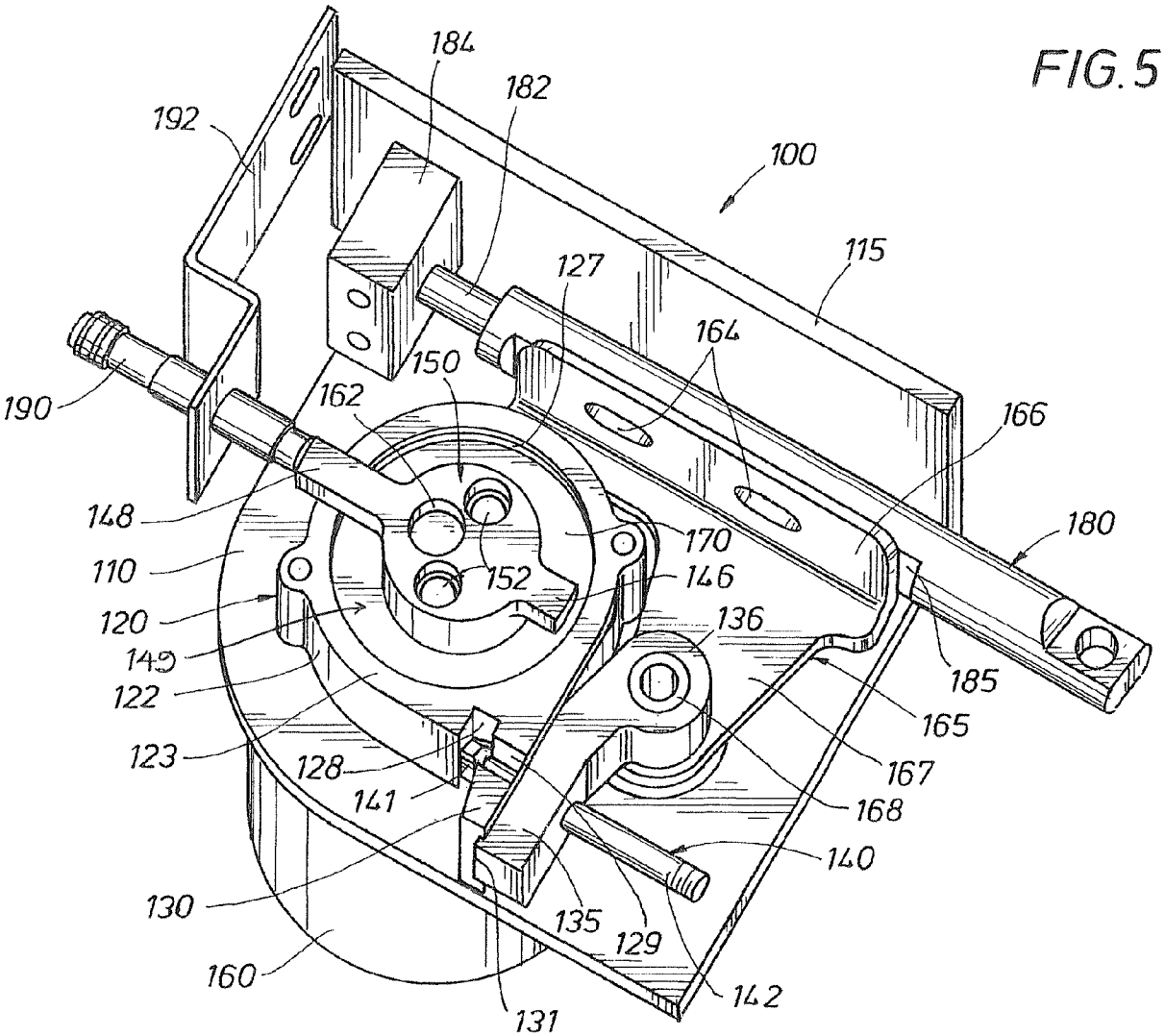
FIG. 5 is a detail perspective view of a holder-shear drive assembly of the bag tying apparatus illustrated in FIG. 1.

Referring to FIG. 5 of the drawing, a holder-shear drive assembly 100 according to the invention has an eccentric element 149 mounted fixedly on a drive shaft 162, the eccentric element rotated by the drive shaft. A housing 122 is slidingly mounted on the eccentric element 149, the housing reciprocated along a housing path by the rotating eccentric element. A reciprocating member 180 is operatively connected to the housing to be reciprocated by the housing, the reciprocating member operatively connected to the holder-shear assembly 60 to actuate the holder-shear assembly. The reciprocating member 180 operable to travel along a reciprocating member path, the reciprocating member limited in its travel at both ends of the reciprocating member path by the holder-shear assembly, wherein the housing path is greater than the reciprocating member path, and wherein the housing over-travels the reciprocating member.

According to the invention, the bag tying apparatus 10 includes an over-travel compensation assembly 134. The over-travel compensation assembly 134 connects the housing 122 to the reciprocating member 180, wherein the over-travel compensation assembly 134 is operable to allow the housing 122 to move in relation to the reciprocating member 180 when the reciprocating member is at either of the ends of the reciprocating member path, whereby the housing is allowed to travel along the housing path that is greater than the reciprocating member path.

The holder-shear drive assembly 100 and the over-travel compensation assembly 134 are best illustrated in FIGS. 5, 6, and 8-11 of the drawing.

Figure 6:
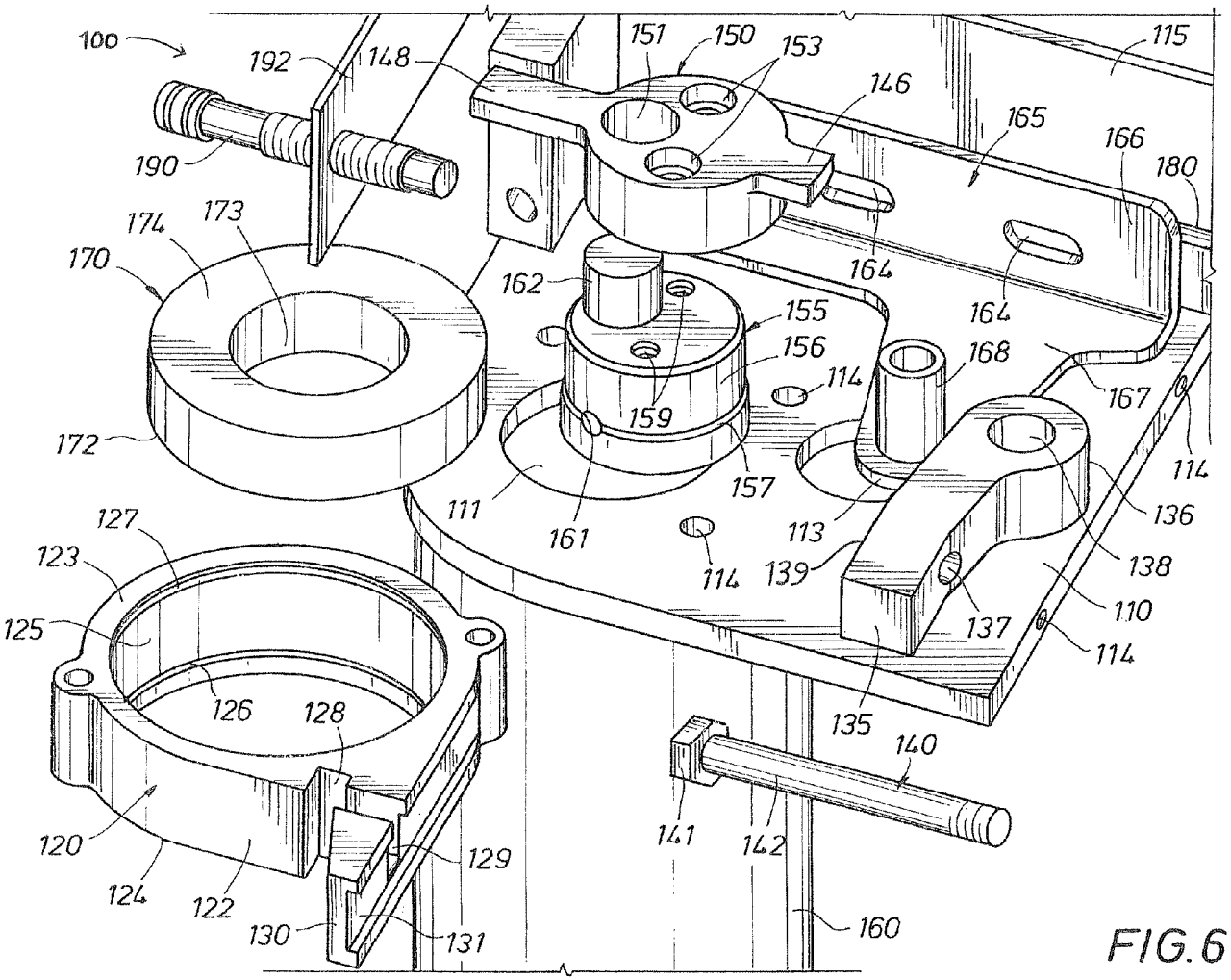
FIG. 6 is a perspective exploded view of selected elements of the holder-shear drive assembly of the bag tying apparatus illustrated in FIG. 1.
Figure 7:
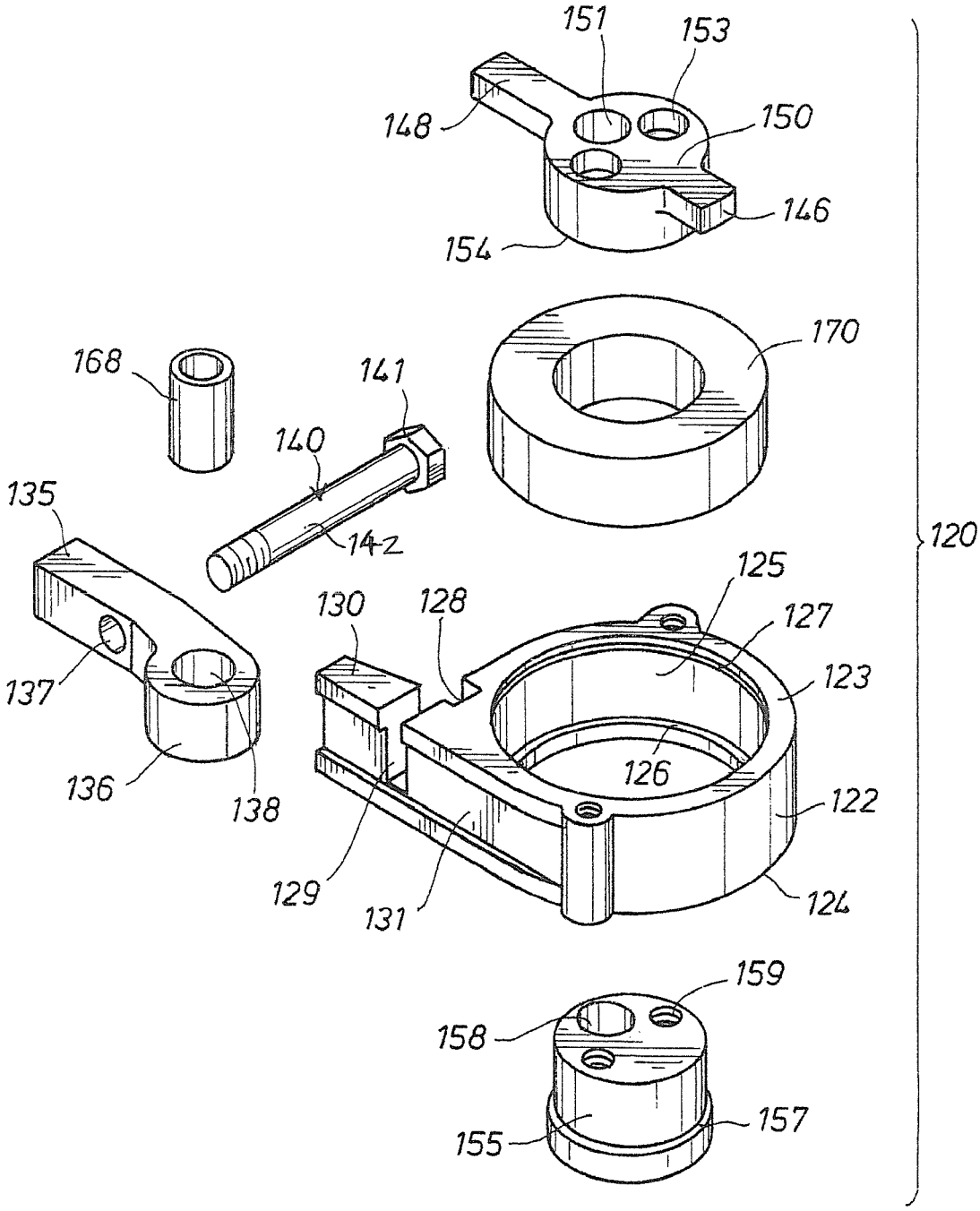
FIG. 7 is an exploded perspective view of selected elements of a cam assembly of the holder-shear drive assembly illustrated in FIG. 6.

FIG. 5 is a perspective view of the holder-shear drive assembly 100 and the over-travel compensation assembly 134 (not showing spring 145, washer 144, and tensioning nut 143, which are illustrated in FIGS. 8-11). FIG. 6 is an exploded perspective view of the holder-shear drive assembly 100 and the over-travel compensation assembly 134 (not showing spring 145, washer 144, and tensioning nut 143, which are illustrated in FIGS. 8-11. FIG. 7 is an exploded view of a cam assembly 120 including the housing 122 of the holder-shear drive assembly 100 and an actuating arm 135, bolt 140, and pivot spacer 168 of the over-travel compensation assembly 134. FIGS. 8-11 show the holder-shear drive assembly 100 and the over-travel compensation assembly 134 at various points in the rotation of the drive shaft 162, orbit of housing 122, and translation of reciprocating member 180 and lever arm 135.

Holder-Shear Drive Assembly

Referring to FIG. 5, the holder-shear drive assembly 100 includes a cam assembly 120 and a reciprocating member 180.

The cam assembly 120 and the reciprocating member 180 are operatively mounted on mounting plate 110. A side plate 115 provides additional structural stability for this mounting. Plate 110 has a central opening 111 and a plurality of threaded apertures 114 for receiving set screws for connecting an upper end of the motor 160 to the mounting plate 110. Referring to FIG. 6, mounting plate 110 has internally threaded apertures 114, which are adapted to receive bolts for attaching the mounting plate 110 to the upper faceplate 16 of bag tying apparatus 10. The side plate 115 is bolted to or otherwise secured to an edge of the mounting plate 110. Side plate 115 has internally threaded apertures 116 formed in an edge thereon, which receives bolts for attaching side plate 115 to an upper faceplate 16 of a bag tying apparatus 10.

As best shown in FIGS. 6 and 7, the cam assembly 120 includes an eccentric element 149, a bearing 170, and the housing 122.

The eccentric element 149 includes a lower eccentric base 155 and an upper eccentric cap 150. The lower eccentric base 155 is mounted on the drive shaft 162 of motor 160 (where the motor 160 is not shown in FIG. 7). Lower eccentric base 155 has a passage 158 for receiving motor drive shaft 162 and internally threaded passages 159 for receiving setscrews 152 for securing the eccentric cap 150 to eccentric base 155, which are secured to the shaft 162 of motor 160 by a setscrew 161. A shoulder 157 extends outwardly from the generally cylindrical outer surface 156 of base 155 and engages the lower surface 172 of bearing 170 when eccentric base 155 is positioned in the central opening 173 of the bearing 170.

Upper eccentric cap 150 of the eccentric element 149 has a passage 151 for receiving motor drive shaft 162 and counter sunk passages 153 for receiving setscrews 152, which are received in internally threaded passages 159 in lower eccentric base 155. Upper eccentric cap 150 also is provided with a socket formed in the lower surface for receiving the upper end of eccentric base 155.

The outer lower edge of bearing 170 engages shoulder 126 on inner wall 125 of housing 122 when bearing 170 is positioned in the passage through housing 122 and a snap ring (not shown) positioned in a groove 127 engages the outer upper edge of bearing 170. The lower surface 124 of housing 122 is spaced from the upper surface of mounting plate 110, as is the lower surface of arm 167 on bracket 165. The eccentric elements 150 and 155 are secured to and supported by setscrew 161 to motor shaft 162.

Referring to FIGS. 5, 6, and 7, the housing 122 includes a body having an upper surface 123, a lower surface 124, and an internal cylindrical wall 125. The wall 125 has a shoulder 126 extending inwardly adjacent the lower surface 124 of housing 122 and a snap ring groove 127 adjacent upper surface 123 of housing 122. A snap ring (not shown) can be positioned in the snap ring groove 127 to restrain the bearing 170.

The rear end of reciprocating member 180 is supported by a pin 182, which is allowed to reciprocate through an opening in a block 184 secured to side plate 115, while the front end of reciprocating member 180 is supported by a bearing in an opening formed in lower faceplate 17. A flat surface 185 is formed on a central portion of reciprocating member 180 to facilitate connecting to flange 166 on bracket 165.

The cam assembly 120 is operatively connected to reciprocate the reciprocating member 180. As best shown in FIGS. 6 and 7, the housing 122 includes an actuating lever 130 for use in operatively connecting the housing 122 to reciprocate the reciprocating member 180. An elongated channel 131 is formed in the side of the housing 122 and the actuating lever 130. A groove 128 is formed in housing 122 adjacent the lever 130 and a slot 129 is formed in actuating lever 130 adjacent the groove 128.

Over-Travel Compensation Assembly

The over-travel compensation assembly 134 preferably includes an actuating arm 135, a bolt 140, a spring 145, a washer 144, and a tensioning nut 143. As best shown in FIGS. 5, 6, and 7, the bolt 140 connects the actuating arm 135 to the housing 122. The bolt 140 has a head 141 and a shank 142. The shank 142 of the bolt 140 extends through a slot 129 when head 141 is positioned in groove 128.

The actuating arm 135 has a boss 136 formed on one end thereof and a hole 138 for receiving a pivot shaft 168. The actuating arm 135 has a passage 137 into which the shank 142 of bolt 140 extends for positioning actuating arm 135 in the elongated channel 131 formed in actuating lever 130 on housing 122. As best illustrated in FIGS. 8-11, the bolt 140 has a spring 145, washer 144, and a tensioning nut 143 on the shank 142 for urging actuating arm 135 into the elongated channel 131 formed in actuating lever 130. The lower end of pivot shaft 168 is secured to arm 167 on bracket 165, which has a flange 166 in which elongated openings 164 are formed to receive bolts 169 screwed into threaded holes in reciprocating member 180.

The actuator arm 135 has a rocker face 139, which abuts channel 131, seen best in FIG. 6, which provides for a rocking motion, or angular movement, of the actuator arm 135 in relation to the lever 130 of housing 122. The spring 145 is attached and compressed by washer 144 and tensioning nut 143 on the exposed side of the pivot shaft 168. The actuating arm 135 is connected to a bracket 165, which is attached to the reciprocating member 180. The actuating arm 135 is preferably formed of Delrin® acetyl resin commercially available from DuPont.

Proximity Switch

Figure 8:
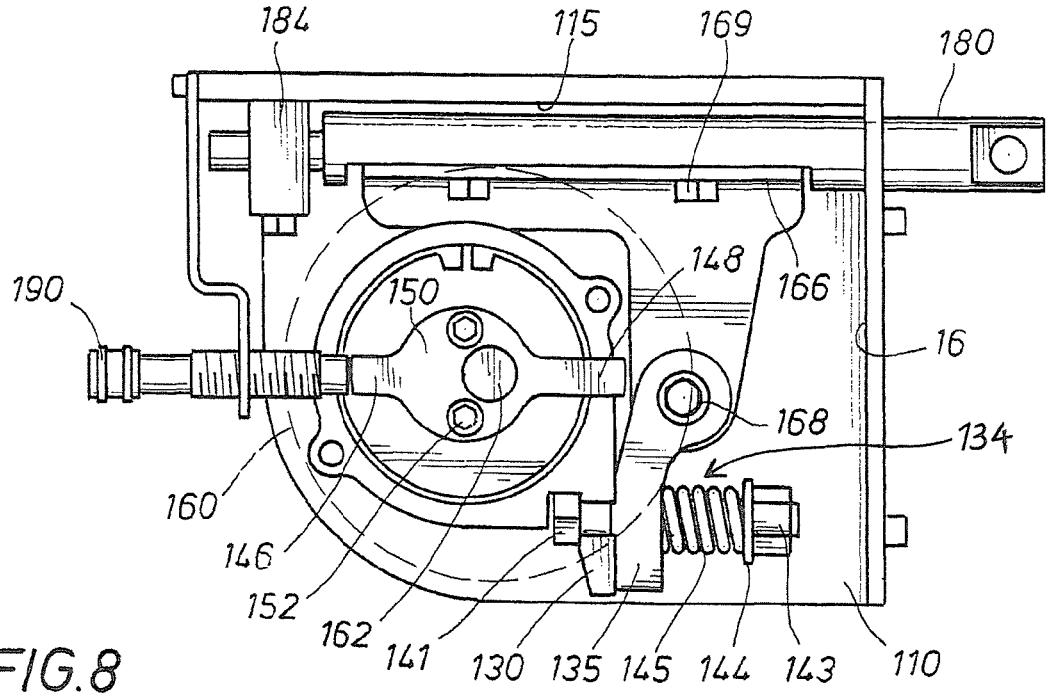
FIG. 8 is a detail front view of the holder-shear drive assembly of the bag tying apparatus illustrated in FIG. 1, showing the holder-shear drive assembly in a first position.
Figure 11:
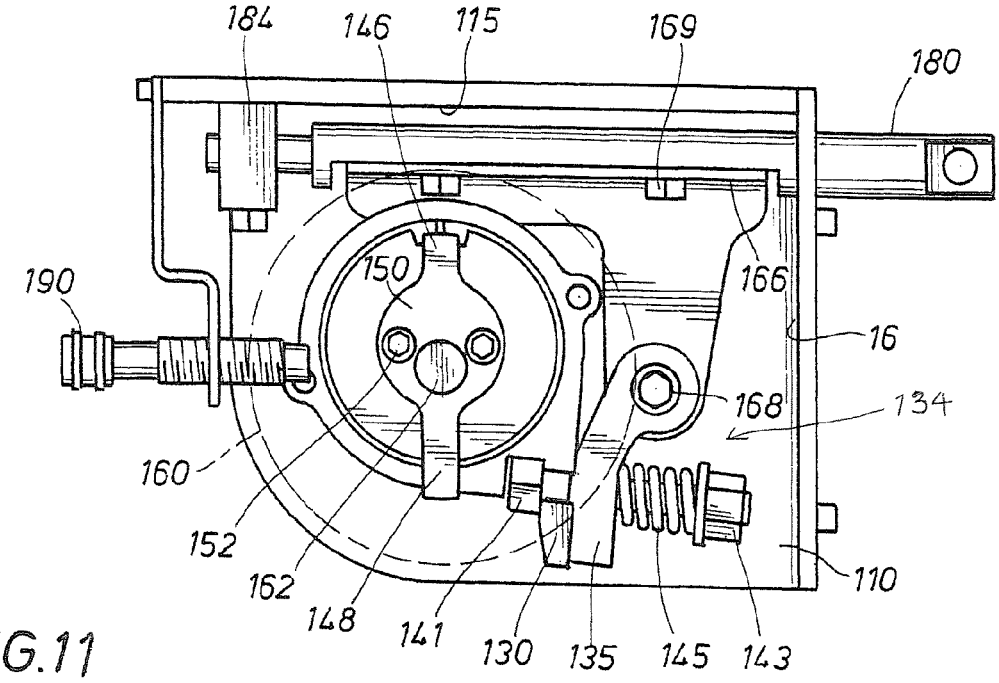
FIG. 11 is a detail front view of the holder-shear drive assembly of the bag tying apparatus illustrated in FIG. 1, showing the holder-shear drive assembly in a fourth position.

The upper eccentric cap 150 has a short proximity switch actuator lug 146 and a long proximity switch actuator lug 148 projecting in opposite directions from motor drive shaft 162. The ends of lugs 146 and 148 are equal distances from the axis of motor shaft 162. When the end of the long proximity switch actuator lug 148 is positioned adjacent proximity switch 190 supported by bracket 192 secured to side plate 115, as illustrated in FIGS. 5 and 11, the high side of the eccentric element urges reciprocating member 180 to the extended position (to the right as viewed in FIG. 11). When the end of the short proximity switch actuator lug 146 is positioned adjacent proximity switch 190, as illustrated in FIG. 8, the high side of the eccentric element urges reciprocating member 180 to the retracted position (to the left as viewed in FIG. 8).

Motions of Holder-Shear and Over-Travel Compensation Assemblies

As shown in FIGS. 8-11, the eccentric element 149, comprising upper eccentric cap 150 and lower eccentric base 155, is confined in bearing 170 in housing 122. As the motor shaft 162 turns, rotating the eccentric element 149 through 180 degrees, the housing 122 translates side to side. The housing 122 also moves up and down, such that the housing moves in an orbital path as the shaft 162 and the eccentric element 149 rotates. The housing 122 is also free to pivot in the up/down direction, allowing it to move angularly in relation to the reciprocating member 180, arm 167, and pivoting actuating arm 135. The housing 122 is operatively connected to actuating aim 135, which is in turn operatively connected to a pivot shaft 168. Actuating arm 135 pivots about pivot shaft 168. The housing 122 and actuating arm 135 are operatively connected to one another via the over-travel compensation assembly 134, including in a preferred embodiment, bolt 140, head 141, tensioning nut 143, washer 144, and spring 145.

As the eccentric element 149 rotates, the reciprocating member 180 is pushed side to side as the housing 122 is free to pivot in the up/down direction. Since the force to move the reciprocating member 180 is being transferred from the eccentric element 149 via the actuator arm 135, when the holder-shear assembly 60 bottoms-out, the over-travel compensation assembly 134 takes up the additional travel of the housing 122. In this way, the motor 160 can turn without feeling the holder-shear assembly 60 bottom out, that is, without bending or placing undue torque on other elements in the bag tying apparatus 10. This over-travel compensation assembly 134 also alleviates the problem of critical adjustments since it can allow a large amount of over-travel without problems.

Turning to FIGS. 8-11, FIG. 8 shows the holder-shear drive assembly 100 in a first position with the drive shaft 162 at its right-most position, and with the orbiting housing 122, actuator arm 135, and reciprocating member 180 at their left-most positions. That is, the reciprocating member 180 has completed its leftward travel, and gripper arm 62 of the holder-shear assembly 60 is engaged with anvil 68. Similarly, the housing 122 and the over-travel compensation assembly 134 are at their left-most positions. The reciprocating member 180 has a shorter distance of travel than the housing 122. The housing 122 of the holder-shear assembly 100 over-travels in comparison to the reciprocating member 180 connected to the holder-shear assembly 60. This over-travel is compensated for, or allowed for, by the over-travel compensation assembly 134. In FIG. 8, the actuator arm 135 has pivoted in relation to arm 167 of the reciprocating member 180. Similarly, the housing 122 is free to pivot as well. These elements continue to move to the left-most position even though the reciprocating member 180 has stopped its leftward motion. The actuator arm 135 has a rocker face 139, which abuts channel 131, seen best in FIG. 6, which provides for a rocking motion, or angular movement, of the actuator arm 135 in relation to the lever 130 of housing 122. As the actuator arm 135 rocks in relation to the lever 130, the spring 145 is compressed slightly.

Figure 9:
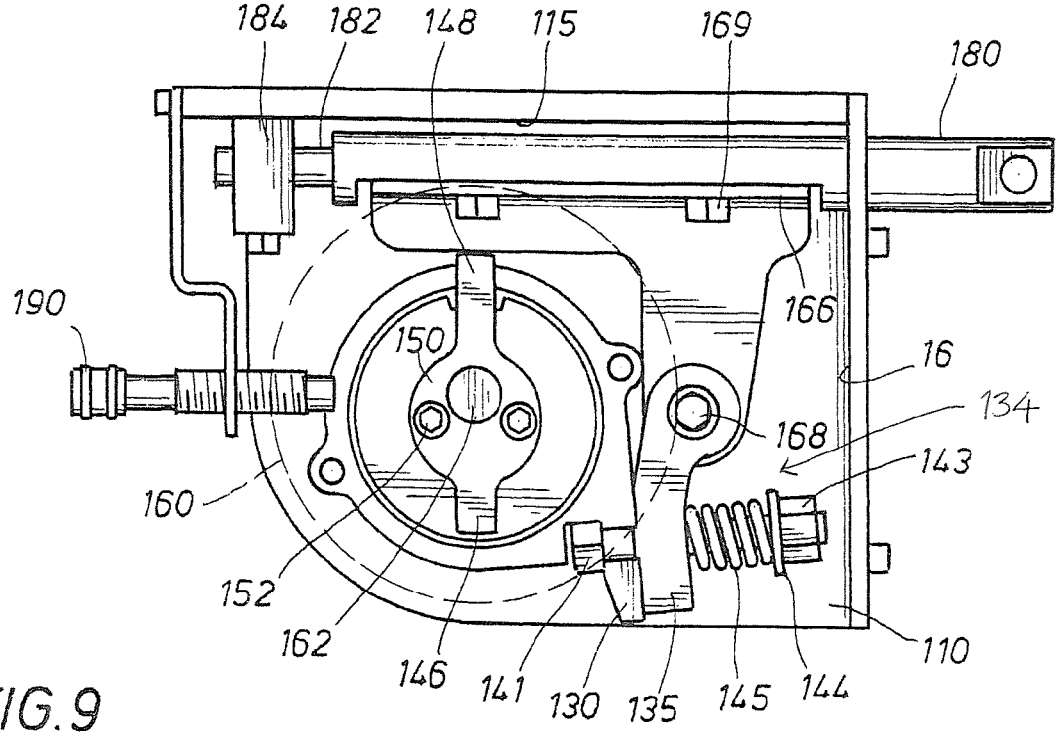
FIG. 9 is a detail front view of the holder-shear drive assembly of the bag tying apparatus illustrated in FIG. 1, showing the holder-shear drive assembly in a second position.

In FIG. 9, the shaft 162 has rotated 90 degrees to a top position. In this position, the reciprocating member 180, which is attached to the holder-shear assembly 60, particularly at gripper arm 62 via link 75*a*, has traveled rightward and gripper arm 62 of the holder-shear assembly 60 is not engaged with an anvil 68 or 69. Also in this position, note that the orbiting housing 122, pivoting actuator arm 135, reciprocating member 180 are moving in synch. The spring 145 operates to hold actuator arm 135 in contact with housing 122 along channel 131.

Figure 10:
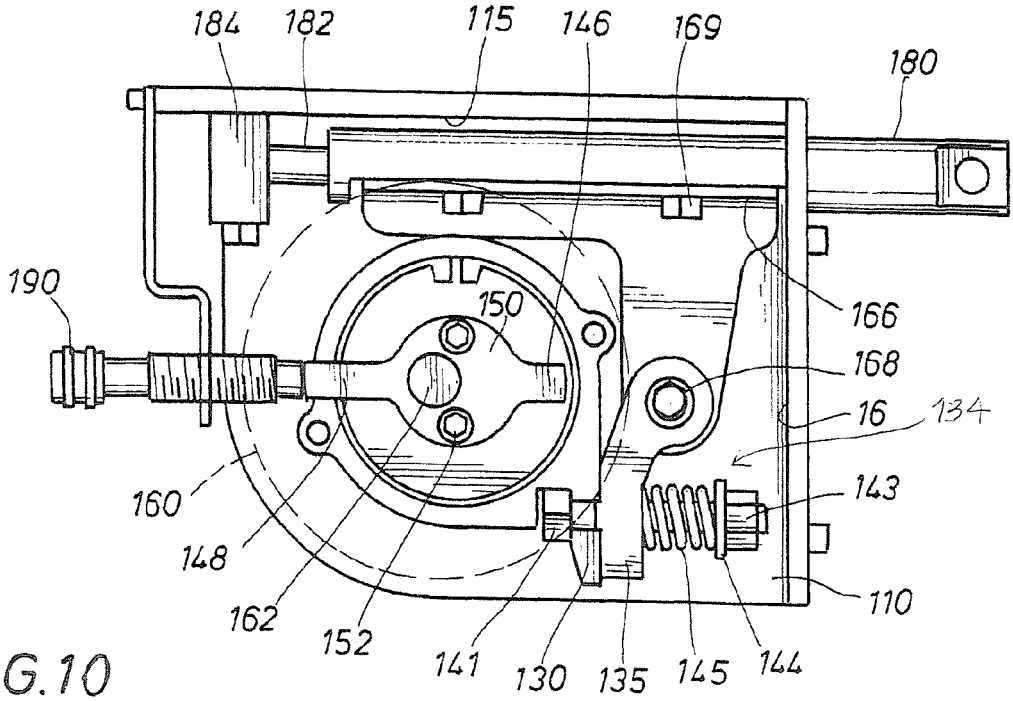
FIG. 10 is a detail front view of the holder-shear drive assembly of the bag tying apparatus illustrated in FIG. 1, showing the holder-shear drive assembly in a third position.

In FIG. 10, the shaft 162 has rotated another 90 degrees to a right-most position, moving the eccentric element and therefore housing 122 to its right-most position, as shown. The reciprocating member 180 is also at its right-most position and has moved the gripper arm 62 such that it is in contact with the other anvil 69. However, the gripper arm 62 of the holder-shear assembly moves into contact with anvil 69 before the reciprocating member 180 completes its path of travel. That is, the holder-shear assembly 60 bottoms-out before the reciprocating member 180 has completed its rightward movement. The housing 122 of the holder-shear assembly 100 over-travels in comparison to the reciprocating member 180 attached to the holder-shear assembly 60. This over-travel is compensated for, or allowed for, by the over-travel compensation assembly 134. In FIG. 10, the actuator arm 135 has pivoted, as has the housing 122. These elements continue to move during rotation of the shaft 162 even though the reciprocating member 180 has stopped its motion. The actuator arm 135 has a rocker face 139, which abuts channel 131, seen best in FIG. 6, which provides for a rocking motion, or angular movement, of the actuator arm 135 in relation to the lever 130 of housing 122. As the actuator arm 135 rocks in relation to the lever 130, the spring 145 is compressed slightly. Note also, that the orbiting housing 122 has pivoted to some degree as well.

In FIG. 11, the shaft 162 has rotated another 90 degrees to its bottom position. The eccentric element 149, housing 122, actuator arm 135 and reciprocating member 180 have traveled leftward into a central position. These elements are situated with respect to one another much as in FIG. 9. The actuator arm has pivoted back to a home position, and is not pivoted along rocker face 139 in channel 131.

Numerous modifications, alterations, subcombinations, and changes can be made in the invention without departing from the spirit and scope of the invention as set forth in the appended claims. It is the intention to cover all embodiments and forms of the invention within the allowable scope of the claims.

What is claimed is:

1. A bag tying apparatus for gathering the open end of a bag into a neck and tying the bag neck closed using a ribbon, the apparatus comprising:

a frame;

a gathering means for gathering the open end of a bag into a neck;

a holder-shear means for holding a free end of the ribbon adjacent to the gathered neck of the bag and, after the neck of the bag is tied, for cutting the ribbon;

a needle means adjacent the holder-shear means, the needle means for engaging the ribbon a distance from the free end and operable to loop a strand of the ribbon about the gathered neck of the bag;

a twister means adjacent the holder-shear means, the twister means for twisting the strand of the ribbon around the gathered neck of the bag;

a holder-shear drive means for actuating the holder-shear means wherein the holder-shear drive means comprises a holder-shear drive assembly comprising:

(a) an eccentric element mounted fixedly on a drive shaft, the eccentric element rotated by the drive shaft;

(b) a housing slidingly mounted on the eccentric element, the housing moved along by the rotating eccentric element; and (c) a reciprocating member operatively connected to the housing to be reciprocated by the housing, the reciprocating member operatively connected to the holder-shear means to actuate the holder-shear means, the reciprocating member operable to travel along a reciprocating member path, the reciprocating member limited in its travel at both ends of the reciprocating member path by the holder-shear means, and wherein the housing over-travels the reciprocating member; and an over-travel compensation means operatively connected between the holder-shear drive means and the holder-shear means, the over-travel compensation means for compensating for over travel of the holder-shear drive means relative to the travel of the holder-shear means;

wherein the gathering means, the holder-shear means, the needle means, the twister means, the holder-shear drive means, and the over-travel compensation means are operatively supported by the frame.

2. The bag tying apparatus according to claim 1, wherein the gathering means comprises a gathering assembly.

3. The bag tying apparatus according to claim 1, wherein the holder-shear means comprises a holder-shear assembly.

4. The bag tying apparatus according to claim 1, wherein the needle means comprises a needle assembly.

5. The bag tying apparatus according to claim 1, wherein the twister means comprises a twister assembly.

6. The bag tying apparatus according to claim 1, wherein the over-travel compensation means comprises an over-travel compensation assembly.

7. The bag tying apparatus according to claim 6, wherein the over-travel compensation means comprises an over-travel compensation assembly connecting the housing to the reciprocating member, wherein the over-travel compensation assembly is operable to allow the housing to move in relation to the reciprocating member when the reciprocating member is at either of the ends of the reciprocating member path.

8. The apparatus according to claim 7, wherein the over-travel compensation means comprises a pivoting actuating arm, the actuating arm connected to the reciprocating member at a pivot point, the actuating arm pivoting when the reciprocating member reaches the end of its reciprocating path and the housing is still traveling along the housing path.

9. The apparatus according to claim 8, wherein the over-travel compensation means comprises a spring operatively connected between the actuating arm and the housing.

10. The apparatus according to claim 9, wherein the operative connection of the spring comprises a bolt and a tensioning nut, wherein the bolt extends between the actuating arm and the housing, and wherein the spring is operatively positioned on the bolt.

11. The apparatus according to claim 10, wherein the actuating arm has a rocker face in abutment with an opposing face on the housing, and wherein the actuating arm pivots with respect to the housing along the rocker face, and wherein the spring compresses when the actuating arm pivots with respect to the housing.

12. The apparatus according to claim 1, wherein the housing path defines an orbital path.

13. The apparatus according to claim 12, wherein the housing is further mounted for pivotal movement.

14. The apparatus according to claim 1, wherein the housing is slidingly mounted on the eccentric element by a bearing interposed between the housing and the eccentric element.

15. The apparatus according to claim 1, further comprising a proximity switch mounted adjacent the eccentric element, at least one proximity lug mounted to the eccentric element to rotate with the eccentric element, the at least one proximity lug actuating the proximity switch when the eccentric element is in a preselected position.

16. The apparatus according to claim 15, wherein the at least one proximity lug comprises two proximity lugs, each lug an equal distance from the drive shaft.

17. The apparatus according to claim 1, further comprising a sensor operatively connected to the conveyor means for indicating a new tying cycle.

18. A bag tying apparatus for gathering the open end of a bag into a neck and tying the bag neck closed using a ribbon, the apparatus comprising:

a frame;

a gathering apparatus for gathering the open end of a bag into a neck;

a holder-shear apparatus for holding a free end of the ribbon adjacent to the gathered neck of the bag and, after the neck of the bag is tied, for cutting the ribbon;

a needle apparatus adjacent the holder-shear means, the needle means for engaging the ribbon a distance from the free end and operable to loop a strand of the ribbon about the gathered neck of the bag;

a twister apparatus adjacent the holder-shear means, the twister means for twisting the strand of the ribbon around the gathered neck of the bag;

a holder-shear drive apparatus for actuating the holder-shear means wherein the holder-shear drive apparatus comprises a holder-shear drive assembly comprising:

(a) an eccentric element mounted fixedly on a drive shaft, the eccentric element rotated by the drive shaft;

(b) a housing slidingly mounted on the eccentric element, the housing moved along by the rotating eccentric element; and (c) a reciprocating member operatively connected to the housing to be reciprocated by the housing the reciprocating member operatively connected to the holder-shear apparatus to actuate the holder-shear apparatus, the reciprocating member operable to travel along a reciprocating member path, the reciprocating member limited in its travel at both ends of the reciprocating member path by the holder-shear apparatus, and wherein the housing over-travels the reciprocating member; and an over-travel compensation assembly operatively connected between the holder-shear drive assembly and the holder-shear assembly, the over-travel compensation assembly for compensating for over travel of the holder-shear drive assembly relative to the travel of the holder-shear assembly;

wherein the gathering apparatus, the holder-shear apparatus, the needle apparatus, the twister apparatus, the holder-shear drive apparatus, and the over-travel compensation assembly are operatively supported by the frame.

19. The bag tying apparatus according to claim 18, wherein the over-travel compensation means comprises an over-travel compensation assembly connecting the housing to the reciprocating member, wherein the over-travel compensation assembly is operable to allow the housing to move in relation to the reciprocating member when the reciprocating member is at either of the ends of the reciprocating member path.

20. The apparatus according to claim 19, wherein the over-travel compensation means comprises a pivoting actuating arm, the actuating arm connected to the reciprocating member at a pivot point, the actuating arm pivoting when the reciprocating member reaches the end of its reciprocating path and the housing is still traveling along the housing path.

* * * * *